United States Patent [19]

Harris

[11] Patent Number: 4,640,713

[45] Date of Patent: Feb. 3, 1987

[54] TARNISH REMOVER/METAL POLISH FORMULATION COMPRISING A METAL IODIDE, AN ACID, AND WATER

[75] Inventor: Robert B. Harris, Racine County, Wis.

[73] Assignee: S. C. Johnson & Son, Inc., Racine, Wis.

[21] Appl. No.: 672,966

[22] Filed: Nov. 19, 1984

[51] Int. Cl.[4] ..... C09G 1/04; C09G 1/06

[52] U.S. Cl. ..... 106/3; 106/10

[58] Field of Search ..... 106/3; 252/106

[56] References Cited

U.S. PATENT DOCUMENTS

| | | | |
|---|---|---|---|
| 840,167 | 1/1907 | Springborn et al. | 106/6 |
| 1,280,939 | 10/1918 | Allen | 106/3 |
| 1,737,222 | 11/1929 | Dewey, Jr. | 106/9 |
| 1,995,219 | 3/1935 | Pape | 106/9 |
| 2,183,037 | 12/1939 | Bayliss | 252/106 |
| 2,992,946 | 7/1961 | Arden et al. | 134/29 |
| 3,385,682 | 5/1968 | Lowen | 106/3 |
| 3,458,300 | 7/1969 | Duvall et al. | 106/3 |
| 3,502,503 | 3/1970 | Bartlo et al. | 134/2 |
| 3,518,098 | 6/1970 | Ford et al. | 106/3 |
| 3,582,366 | 6/1971 | Brieger et al. | 106/271 |
| 3,687,855 | 8/1972 | Halpern | 252/106 |
| 3,879,216 | 4/1975 | Austin | 134/4 |
| 3,914,161 | 10/1975 | Yonezawa et al. | 204/44 |
| 3,997,460 | 12/1976 | Sirine | 252/106 |
| 4,097,590 | 6/1978 | Weisz | 252/106 |
| 4,116,699 | 9/1978 | Rooney | 106/3 |
| 4,207,310 | 6/1980 | Langford | 252/106 |
| 4,444,756 | 4/1984 | Schlüssler | 252/106 |

*Primary Examiner*—Theodore Morris

[57] ABSTRACT

A tarnish remover/metal polish formulation comprising water, an acid, and metal iodide, such as potassium iodide, is described. The components of the formulation chemically react with the tarnish or stain on a metal surface, removing the tarnish or stain while leaving the metal unaffected. The tarnish remover/metal polish can be applied as a dip-rinse or as a polish. The composition is easily applied and easily removed.

17 Claims, No Drawings

TARNISH REMOVER/METAL POLISH FORMULATION COMPRISING A METAL IODIDE, AN ACID, AND WATER

FIELD OF INVENTION AND BACKGROUND

The present invention relates to an improved tarnish remover. More particularly this invention relates to a tarnish remover/metal polish containing as essential ingredients a metal iodide such as potassium iodide, an acid, and water. The tarnish removers/metal polishes of this invention are effective, safe, and low in cost.

In the prior art many formulations have been proposed for removing tarnish and oxides from silver, copper, brass, and other metals. "Tarnish," as the term is used herein, embraces a film discoloration of the metal surface which occurs as a result of a chemical change in the metal as opposed to a mere physical soiling. An example is the formation of a sulfide or oxide film which is from all indications integral with the metal surface and similar to metal corrosion. The prior art formulations which have been proposed have been designed to either only remove the tarnish, etc., or to remove the tarnish, etc., and additionally repress the tendency of metal surfaces to re-tarnish or stain upon exposure to ordinary atmospheric conditions, thereby eliminating at least partially a periodic, time-consuming cleaning problem and to prevent a deterioration of the metal surfaces.

The prior art tarnish removers or metal polishes designed primarily to remove tarnish and stain conventionally comprise an abrasive material and a carrier such as water, a hydrocarbon solvent, or glycerine, either with or without a soap or an emulsified agent. Tarnish removers and metal polishes designed to repress tarnish and stain have included a film-forming material in the compositions such as waxes and resins so as to leave behind a thin coating, and in addition the use of anti-tarnish components such as a mercaptan or thiourea for the prevention of retarnishing. Exemplary prior art tarnish removers or metal polishes include the compositions described in U.S. Pat. No. 2,628,199 which utilize thiourea in an acidic dip-type silver and copper cleaning composition; U.S. Pat. No. 2,691,593 which discloses silver cleaning compositions in paste or liquid form containing abrasives, an emulsifying agent, a hydrocarbon carrier and, if desired, a mercaptan or thiourea; and U.S. Pat. No. 2,841,501 which discloses a silver polish containing a mild abrasive and a long chain alkyl mercaptan as an anti-tarnishing agent. The mercaptan apparently forms a thin protective film upon the silver and prevents retarnishing.

The aforesaid silver and copper cleaners and polishes are useful and have met with substantial approval. However, each has disadvantages and limitations. It has been found that certain of the acidic dip type formulations have a deleterious effect upon silverware, possibly resulting in more rapid retarnishing after the silver is again exposed to normal use and possibly causing removal of the silver surface. The compositions apparently function primarily as a cleaner and provide little or no protective coating. On the other hand, polishing compositions of the type described in U.S. Pat. No. 2,691,593, because of the hydrophobic carrier employed, are relatively difficult to wash off the silver after polishing. There is also an indication that the silver tarnishes more easily after initial cleaning. The rapid retarnishing may be a result of more exposed silver surface due to scratches on the silverware. Some polish-type formulations are believed to remove some of the metal surface when used. Additionally, a number of the prior art polishes or tarnish removers containing chemicals, such as thiourea, have toxic characteristics, some suspected to be carcinogenic, and for that reason are not well received.

PRIMARY OBJECTS AND GENERAL DESCRIPTION OF INVENTION

It is a primary object of the present invention to provide a tarnish remover for metal surfaces which will rapidly remove tarnish from the metal with little or no erosion of the metal surface.

It is another primary object of the present invention to provide a tarnish remover which will rapidly remove tarnish and which is safe to use both from the standpoint of toxicity and from the standpoint of erosion of the metal surfaces.

It is another object of the present invention to provide a tarnish remover which is readily removed from the surface of the metal being polished or cleaned after the cleaning application.

It is another object of the present invention to provide a tarnish remover and metal polish composition which will protect the cleaned metal surface against retarnishing.

It is another object of the present invention to provide an aqueous base metal polish or tarnish remover composition which can be stored for a substantial period without separation of the components of the composition.

These and other objects of the invention will become more apparent from the following detailed description, with particular reference to the preferred embodiments set forth in the working examples.

According to the present invention an improved tarnish remover/metal polish formulation is provided containing as essential ingredients water, an acid, and a metal iodide, such as potassium iodide. It is theorized that the components of the formulation react with the tarnish on the metal to chemically remove the tarnish. Although the reaction mechanism is not completely understood, it is theorized that in the case of silver tarnish caused by sulfur in the atmosphere one possible reaction is—

$$\underset{\text{phosphoric acid}}{H_3PO_4} + \underset{\text{potassium iodide}}{2KI} + \underset{\text{silver sulfide}}{Ag_2S} \longrightarrow \underset{\text{hydrogen sulfide}}{H_2S} + \underset{\text{silver}}{2Ag} + \underset{\text{potassium biphosphate}}{K_2HPO_4} + \underset{\text{iodine}}{I_2}$$

The aforesaid reaction is proposed as only a possible reaction and may, in fact, not be the actual reaction that takes place. It is believed clear, however, that the silver polish of this invention does function in removing tarnish and stains through a chemical reaction. The reaction, while removing tarnish and stain, does not damage or erode the metal surface. Moreover, the composition is safe in the sense that the materials are not in and of themselves toxic, nor are they toxic when used in combination.

In the tarnish remover/metal polish formulations of the present invention the metal iodide can be any metal iodide which is reactive with a metal salt such as silver sulfide in the presence of an acid. The metal iodides found particularly useful are potassium iodide, sodium iodide, lithium iodide, magnesium iodide, calcium iodide, rubidium iodide, and cesium iodide. Other metal iodides, however, can be utilized as long as the metal iodide as previously stated is reactive with a tarnish- or stain-producing compound in the presence of an acid. The acid which can be utilized in the present invention can be either an inorganic or organic acid. Acids which have been found to be particularly suitable include sulfuric acid, citric acid, phosphoric acid, sulfonic acid, tartaric acid, and acetic acid. The acids which are to be employed include any of the acids which will react with the metal iodide and a silver compound such as silver sulfide or silver oxide, or the like, which is the tarnish or stain product usually associated with tarnish or discoloration of metal surfaces.

The proportions and method of mixing the ingredients of the tarnish remover/metal polishes of the present invention are not particularly critical, there being a fairly wide range of operable proportions depending upon whether the preparation is to be used as an aqueous polish or as a dip-rinse preparation. The metal iodide and acid, however, must be present in an amount sufficient to react with the tarnish- or stain-forming ingredient on the metal surface in the presence of water. The metal iodide should be present, therefore, in an amount of from about 5 to 25% by weight, the acid should be present in an amount of from about 0.1 to 25% by weight, with the balance of the formulation being water or an ancillary material such as an abrasive, surfactant, co-solvent, or the like which in certain preparations will enhance the cleaning and removability characteristics of the tarnish remover or metal polish. Preferred percentages by weight are from about 3 to 8% of acid, 8 to 15% of the metal iodide, 0 to 15% abrasive, 0 to 3% surfactant, and up to about 10% of the carrier being an organic co-solvent.

The tarnish remover polish compositions, while being capable of being utilized as the aqueous solution of only an acid and metal iodide, can also be used in combination with other ingredients such as abrasives, surfactants, co-solvents, perfumes, humectants, and stabilizers in the amount as stated above. The presence of the additional materials will provide enhanced cleaning and/or contribute to the removability of the formulation after application. Abrasives which have been found useful include the abrasives conventionally employed as cleaners such as calcium carbonate, the silicas, aluminas, diatomaceous earth, bentonite, charcoal, infusorial earth, pumice, brick clay, tripoli, and the like. The surfactants which are useful according to the present invention include the nonionic, cationic, and anionic surfactants which are conventionally used in cleaner compositions and as wetting agents such as the nonylphenols, ethoxylated alcohols, alkyl sulfates, coconut fatty acid, alkanolamine condensates, and the like. The stabilizers which can be utilized include the conventional stabilizers such as the hydroquinones, sodium sulfide, glycerine, and the like. The co-solvents include the conventionally used solvents for use in cleaner compositions such as the cellosolves, hydrocarbons such as the isopars, low molecular weight alcohols, and the like. The humectants which can be utilized include propylene glycol, ethylene glycol, glycerine, and other known humectants.

WORKING EXAMPLES AND PRESENTLY PREFERRED EMBODIMENTS

In order to set forth working examples and presently preferred embodiments, the following examples of the present invention are set forth.

Example 1

A silver polish was prepared by mixing ingredients as follows: 12% by weight potassium iodide; 6% by weight phosphoric acid; 0.6% by weight bentonite; 10% by weight diatomaceous earth; 2% by weight butyl cellosolve; 0.5% by weight surfactant (an ethoxylated linear alcohol), and the balance water to make 100%. The metal polish when applied to silverware removed the tarnish and stain with light rubbing. The polish was easily washed off with warm water to provide a bright metal surface.

Example 2

A brass and copper polish was prepared by mixing ingredients as follows: 12% by weight potassium iodide; 8% by weight phosphoric acid; 5% by weight diatomaceous earth; 15% by weight alumina; 0.5% by weight bentonite; 3% by weight butyl cellosolve; 0.5% by weight surfactant (an ethoxylated linear alcohol), 0.1% by weight stabilizer (sodium sulfite), and the balance water to make 100%. The brass and copper polish when applied to brass and copper removed the tarnish and stain with light rubbing. The polish was easily washed off with warm water to provide a bright metal surface.

Example 3

A dip-rinse tarnish remover was prepared utilizing the ingredients as follows: 3% by weight sulfuric acid; 12% by weight potassium iodide; and 85% by weight water. When silverware is dipped into the dip-rinse formulation, the tarnish is rapidly removed to provide a bright metal surface.

Example 4

A dip-rinse tarnish remover was prepared utilizing the ingredients as follows: 4% by weight citric acid; 12% by weight potassium iodide; and 85% by weight water. When silverware is dipped into the dip-rinse formulation, the tarnish was rapidly removed to provide a bright metal surface.

In the aforesaid examples the potassium iodide can be replaced by other metal iodides including sodium iodide, lithium iodide, magnesium iodide, calcium iodide, rubidium iodide, cesium iodide, or a mixture of the metal iodides. The acid can be replaced with other acids, including sulfuric acid, tartaric acid, and hydrochloric acid. The abrasive and surfactant can be replaced by other conventionally employed abrasives and surfactants for cleaning and as wetting agents.

As will be apparent to one skilled in the art, various modifications can be made within the scope of the aforesaid description. Such modifications being within the ability of one skilled in the art form a part of the present invention and are embraced by the appended claims.

It is claimed:

1. An improved tarnish remover/metal polish formulation comprising:

(a) at least one metal iodide in an amount of from about 8 to 25% by weight;
(b) an acid in an amount of from about 0.1 to 25% by weight;
(c) a surfactant in an amount of from about 0.5 to 3% by weight, and;
(d) the balance water.

2. The improved tarnish remover/metal polish formulation of claim 1 wherein the metal iodide is a member of the group consisting of potassium iodide, sodium iodide, lithium iodide, magnesium iodide, calcium iodide, rubidium iodide, cesium iodide, and mixtures thereof.

3. The improved tarnish remover/metal polish formulation of claim 2 wherein the metal iodide is potassium iodide.

4. The improved silver polish formulation of claim 1 wherein said acid is phosphoric acid which is present at from about 3 to 8% by weight.

5. The improved silver polish formulation of claim 1 wherein said acid is citric acid which is present at from about 3 to 8% by weight.

6. The improved silver polish formulation of claim 1 wherein said acid is sulfuric acid which is present at from about 3 to 8% by weight.

7. The improved silver polish formulation of claim 1 wherein said acid is sulfonic acid which is present at from about 3 to 8% by weight.

8. The improved tarnish remover/metal polish formulation of claim 1 wherein said potassium iodide is present at from about 8 to 15% by weight.

9. The metal polish of claim 1 including in addition to said essential ingredients a thickening agent.

10. The metal polish of claim 1 including in addition to said essential ingredients an organic solvent.

11. An improved tarnish remover/metal polish formulation suitable as dip rinse comprising:
(a) from about 3 to 6% by weight of an acid,
(b) from about 8 to 15% by weight of a metal iodide,
(c) a surfactant in an amount of about 0.5 to 3% by weight; and
(d) the balance water.

12. The improved tarnish remover/metal polish formulation of claim 11 wherein the metal iodide is a member of the group consisting of potassium iodide, sodium iodide, lithium iodide, magnesium iodide, calcium iodide, rubidium iodide, cesium iodide, and mixtures thereof.

13. The improved tarnish remover/metal polish formulation of claim 12 wherein the metal iodide is potassium iodide.

14. An improved tarnish remover/metal polish formulation suitable for use as a metal polish comprising from about 3 to 6% by weight of an acid, 8 to 15% by weight of a metal iodide, 4 to 15% of an abrasive, 0.5 to 3% of a surfactant, and the balance water.

15. The improved tarnish remover/metal polish formulation of claim 14 wherein the metal iodide is a member of the group consisting of potassium iodide, sodium iodide, lithium iodide, magnesium iodide, calcium iodide, rubidium iodide, cesium iodide, and mixtures thereof.

16. The improved tarnish remover/metal polish formulation of claim 15 wherein the metal iodide is potassium iodide.

17. The metal polish of claim 1 including in addition to said essential ingredients an abrasive.

* * * * *